United States Patent [19]

Horie et al.

[11] Patent Number: 5,025,740

[45] Date of Patent: Jun. 25, 1991

[54] STITCH PATTERN SEWING MACHINE

[75] Inventors: Fujio Horie; Tomo Inoue, both of Nagoya, Japan

[73] Assignee: Brother Kogyo Kabushiki Kaisha, Nagoya, Japan

[21] Appl. No.: 526,595

[22] Filed: May 22, 1990

[30] Foreign Application Priority Data

Jul. 27, 1989 [JP] Japan ..... 1-195300

[51] Int. Cl.[5] ..... D05B 3/02

[52] U.S. Cl. ..... 112/456; 112/458

[58] Field of Search ..... 112/458, 456, 457, 453, 112/121.12, 266.1, 262.3, 103, 102

[56] References Cited

U.S. PATENT DOCUMENTS

| | | | |
|---|---|---|---|
| 4,309,950 | 1/1982 | Franklin | 112/121.12 X |
| 4,572,095 | 2/1986 | Makabe et al. | 112/456 |
| 4,599,959 | 7/1986 | Sano et al. | 112/458 X |
| 4,704,974 | 11/1987 | Herdeg et al. | 112/458 |
| 4,823,715 | 4/1989 | Horie et al. | 112/315 |

FOREIGN PATENT DOCUMENTS 6152717 4/1982 Japan .

OTHER PUBLICATIONS

BROTHER "LeMieux 7000" brochure, 4/1990, first published 8/1989.

*Primary Examiner*—Peter Nerbun

*Attorney, Agent, or Firm*—Oliff & Berridge

[57] ABSTRACT

A stitch pattern sewing machine includes a ROM for storing triple stitch pattern data for a large size pattern and single stitch pattern data for a small size pattern for each pattern of a plurality of patterns, a pattern selecting unit for selecting one of the patterns, an enlargement switch for enlarging a size of the pattern selected by the pattern selecting unit, a reduction switch for reducing the size of the pattern selected by the pattern selecting unit, a CPU, and a driving unit for forming a stitch. The CPU selects one of the triple stitch pattern data and the single stitch data based on size of the pattern. The CPU controls the driving unit based on the selected pattern data and size of the pattern. As a result, stitch thickness can be varied with pattern size to maintain a desired appearance.

7 Claims, 4 Drawing Sheets

STITCH PATTERN SEWING MACHINE

BACKGROUND OF THE INVENTION

1. Field of the Invention

The present invention relates to a stitch pattern sewing machine and, more specifically, to a stitch pattern sewing machine capable of sewing original patterns in different sizes.

2. Description of the Related Art

Some conventional stitch pattern sewing machines capable of sewing a plurality of patterns including characters and symbols allow the selection of a desired pattern through the operation of numeric keys and the optional selection of a pattern size for the selected pattern. Generally, each pattern has a predetermined standard size which can be changed within a predetermined range by manually operating a switch or the like. The conventional stitch pattern sewing machine of the type described stores data of a plurality of needle locations to control the needle for pattern sewing. In sewing a selected pattern in a selected pattern size, the distance between the adjacent needle locations is increased or decreased according to the selected pattern size. Some conventional sewing machines store pattern data for a multiple overlap stitch, namely, data for forming multiple stitches between two needle locations.

However, a problem arises in enlarging or reducing the original pattern; that is, since the original pattern is designed with reference to a standard pattern size, the image of an enlarged or reduced stitch pattern differs from that of the corresponding original pattern. This is because the apparent thickness of lines delineating the stitch pattern relative to the pattern size decreases and hence the stitch pattern looks lean when the original pattern is enlarged. On the other hand, the apparent thickness of lines delineating the stitch pattern relative to the pattern size increases and details of the pattern cannot be expressed clearly when the original pattern is reduced. Furthermore, when the original pattern is reduced, stitches are liable to interfere with each other because the distance between the adjacent needle locations is decreased.

SUMMARY OF THE INVENTION

Accordingly, it is an object of the present invention to provide a stitch pattern sewing machine capable of sewing attractive stitch patterns regardless of the sizes of the patterns.

The above object can be achieved, according to the present invention, by a stitch pattern sewing machine comprising:

pattern storage means for storing patterns to be formed on a workpiece;

pattern selecting means for selecting a pattern stored in the pattern storage means;

size setting means for setting a size of the pattern selected by the pattern selecting means;

multiple overlap stitch setting means for setting the number of overlap stitches based on the size of the pattern set by the size setting means; and stitch forming means for forming a stitch pattern corresponding to the pattern selected by the pattern selecting means based on the size of the pattern set by the size setting means and the number of overlap stitches set by the multiple overlap stitch setting means.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENT

Figure 1:
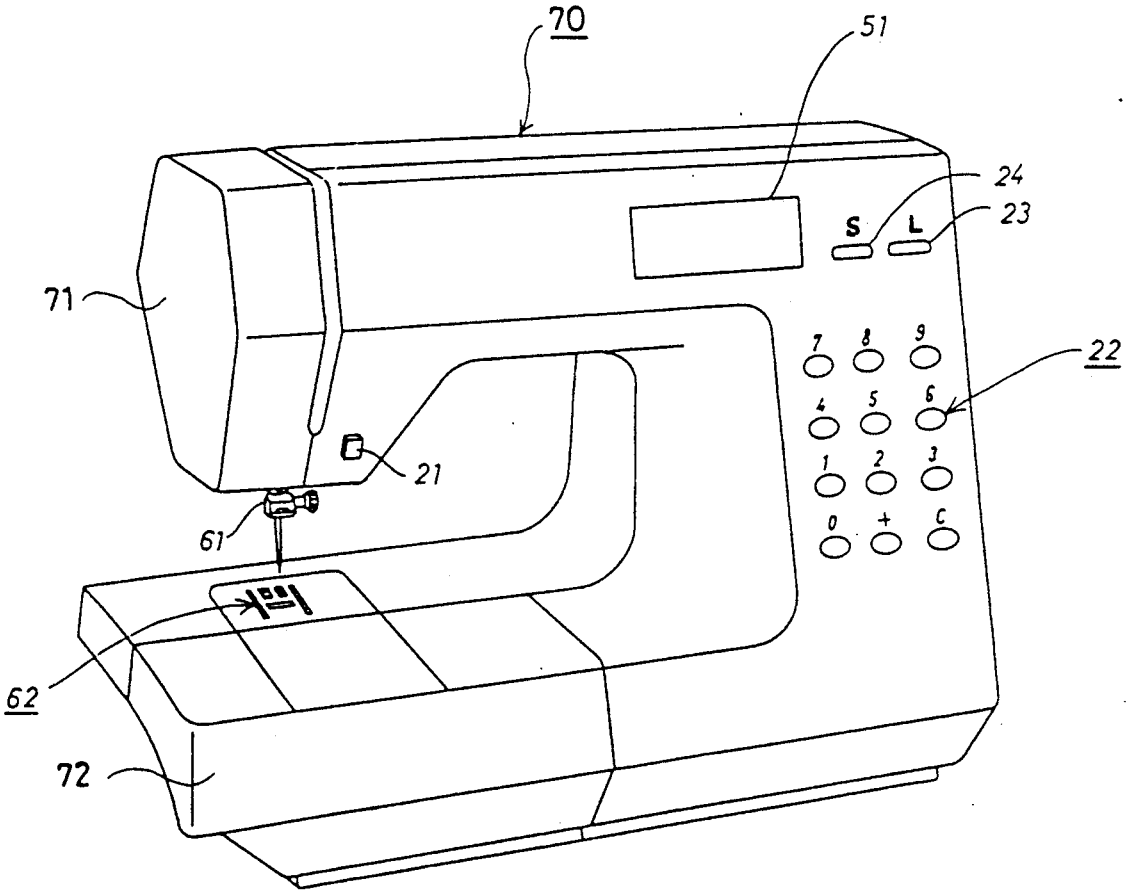
FIG. 1 is a perspective view of a stitch pattern sewing machine in a preferred embodiment according to the present invention.

A stitch pattern sewing machine embodying the present invention has a main frame 70 provided with a start-stop switch 21, a pattern selecting unit 22 comprising numeric keys, an enlargement switch 23 for setting a desired enlargement ratio at which a selected pattern is enlarged, a reduction switch 24 for setting a desired reduction ratio at which a selected pattern is reduced, and a display 51 for displaying the type and size of a selected pattern. A needle bar 61 fixedly holding a needle at its lower end is supported for vertical movement on the head section 71 of the frame 70. The needle bar 61 is driven for vertical reciprocation through a needle bar driving mechanism by a main motor 31 and is driven for swing motion through a needle bar swinging mechanism by a swing motor 35, which will be described afterward. A feed dog 62 is supported for vertical and lengthwise movement on a bed 72. The feed dog 62 is driven for vertical movement through a feed lifting rock mechanism by the main motor 31, and is driven for lengthwise movement through a lengthwise feed mechanism by a feed motor 33. The respective mechanical constructions of the main motor 31, the feed motor 33, the swing motor 35, the needle bar driving mechanism, the needle bar swinging mechanism, the feed lifting rock mechanism and the lengthwise feed mechanism may be of the types disclosed in U.S. Pat. No. 4,823,715.

Figure 2:
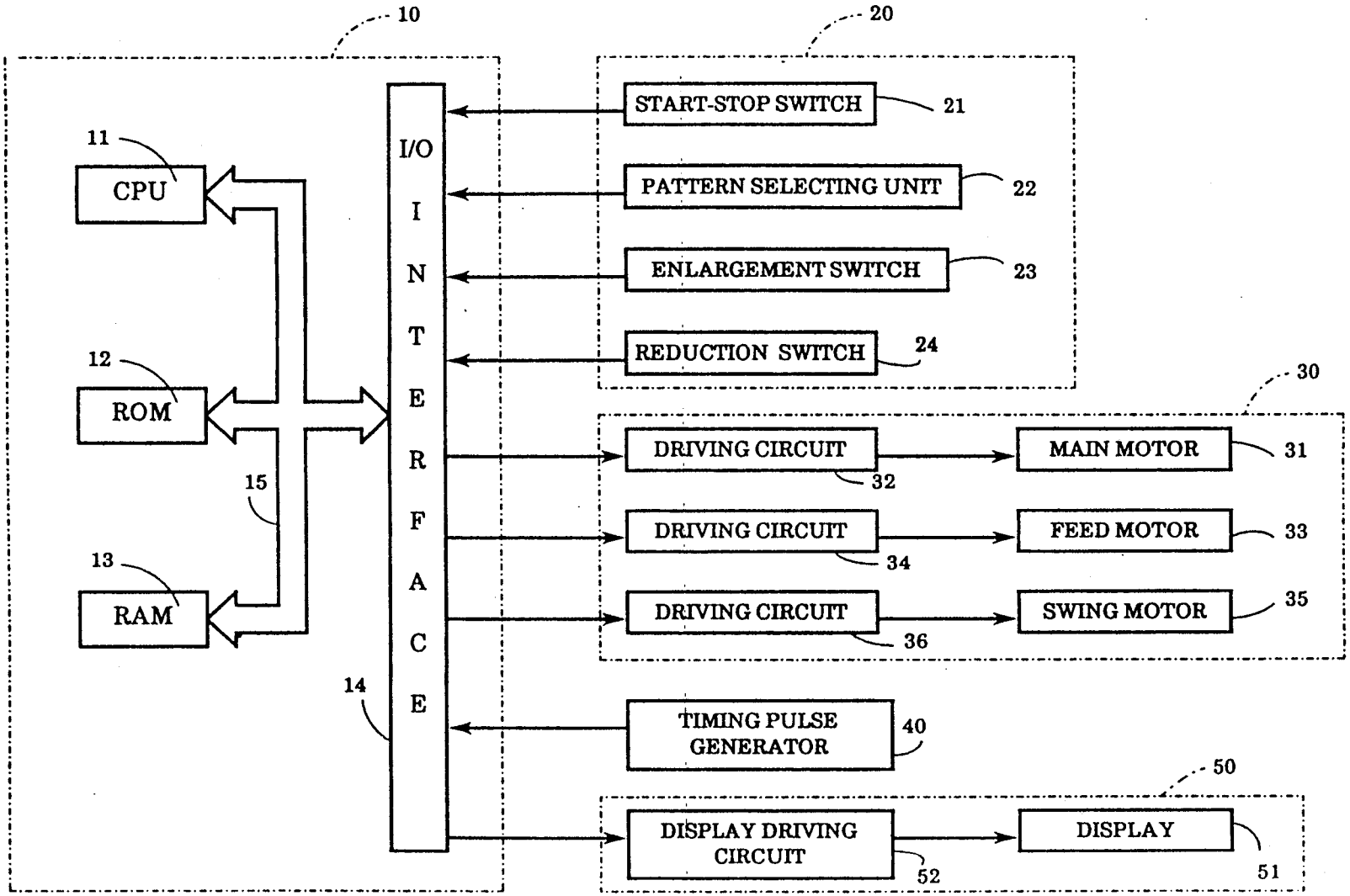
FIG. 2 is a block diagram of an electrical system included in the stitch pattern sewing machine of FIG. 1.

The electrical configuration of the stitch pattern sewing machine will be described hereinafter. Referring to FIG. 2, the stitch pattern sewing machine is provided with an electronic controller 10 which controls the general sewing operation, a sewing condition setting unit 20, a driving unit 30 which drives the sewing mechanism, a timing pulse generator 40 which generates a timing signal according to the operation of the sewing mechanism, and a display unit 50 which displays sewing information including a pattern selected by operating the switch unit 20 and a selected pattern size.

The electronic controller 10 comprises a known CPU 11, a ROM 12, a RAM 13, an I/0 interface 14 which converts input signals given from external devices to the CPU 11 into signals for processing by the CPU 11, and a bus 15 interconnecting the CPU 11, the ROM 12 and the RAM 13.

The ROM 12 stores a plurality of pattern data specifying needle positions (positions of the needle on a workpiece) for characters, symbols and patterns, a control program for controlling the driving unit 30 according to commands given by operating the switch unit 20, a control program for controlling the display unit 50 and a control program for controlling the stitch mode selecting operation. Each of the plurality of pattern data includes two stitch data respectively for a single stitch mode and a triple stitch mode. In the triple stitch mode, three stitches are formed between two adjacent needle positions.

The RAM 13 includes an address pointer for specifying the respective addresses of pattern data, a memory for storing pattern data specified by the address pointer, flags, a stitching cycle counter, and a buffer memory for temporarily storing the results of operation of the CPU 11.

The switch unit 20 which gives signals to the I/0 interface 14 of the electronic controller 10 comprises the start-stop switch 21, the pattern selecting unit 22 comprising the numeric keys which are operated to enter a number of two figures representing a pattern to select a desired pattern, the enlargement switch 23, and the reduction switch 24. The standard pattern size, i.e., the default pattern size stored in the ROM 12, of a pattern is enlarged or reduced by one degree every time the pushbutton of the enlargement switch 23 or the pushbutton of the reduction switch 24 is pushed. Thus, a desired pattern size is determined by pushing the pushbutton of the enlargement switch 23 or that of the reduction switch 24 a corresponding number of times. In this embodiment, the pattern width can be changed stepwise in the range of 3 mm to 9 mm in a 0.5 mm step.

The driving unit 30 comprises the main motor 31, a sewing motor driving circuit 32 for driving the main motor 31, the feed motor 33, a feed motor driving circuit 34 for driving the feed motor 33, the swing motor 35 for swinging the needle bar 61 in directions perpendicular to the feed direction in which the workpiece is fed, and a swing motor driving circuit 36 for driving the swing motor 35. The driving circuits 32, 34 and 36 are connected to the I/0 interface 14 of the electronic controller 10 to drive the motors 31, 33 and 35, respectively, according to control signals given thereto by the electronic controller 10.

The timing pulse generator 40 comprises a disk attached to the main shaft of the stitch pattern sewing machine, and a photointerrupter. The timing pulse generator 40 generates a timing pulse signal synchronously with the rotation of the main shaft every turn of the main shaft through a predetermined angle, and gives the timing pulse signal to the electronic controller 10. The driving circuits 34 and 36 control the feed motor 33 and the swing motor 35, respectively, on the basis of the timing pulse signal.

The display unit 50 comprises the display 51 which displays pattern information including the type and size of a selected pattern in a liquid crystal dot matrix, and a display driving circuit 52 for driving the display 51 according to signals provided by the electronic controller 10.

Figure 3A:
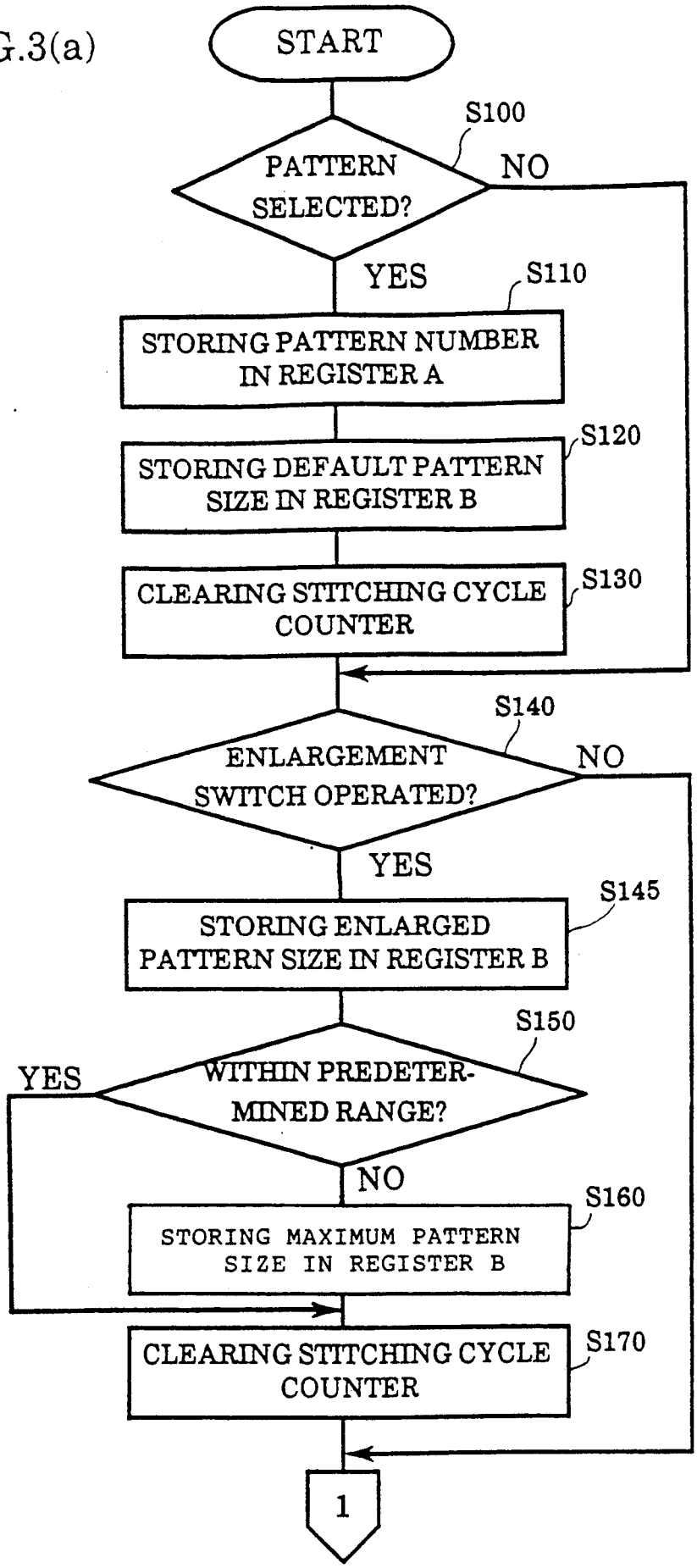
FIGS. 3(*a*) and 3(*b*) are flow charts of a stitch mode selecting routine.
Figure 3B:
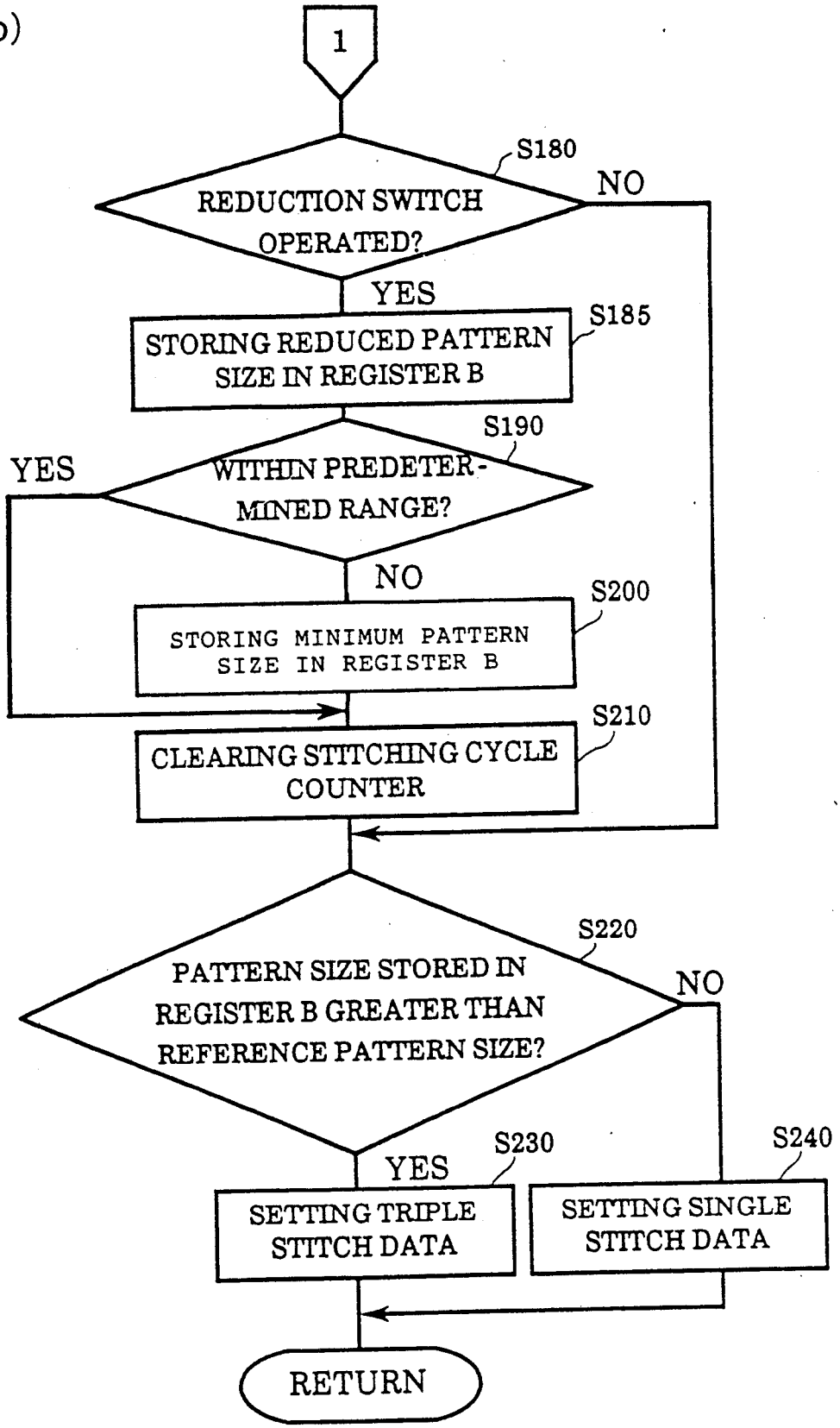

A stitch mode selecting operation to be executed by the electronic controller 10 will be described with reference to a flow chart of a stitch mode selecting routine shown in FIGS. 3(*a*) and 3(*b*). The stitch mode selecting routine is repeated at predetermined time intervals.

In step 100, a query is made to see if a pattern is selected. A pattern is selected by entering a pattern number of two figures specifying the pattern by operating the pattern selecting switch unit 22. When the response in step 100 is affirmative, namely, when a pattern number is entered, the pattern number is stored in the register A of the RAM 13 in step 110. Subsequently, the default pattern size of the pattern stored previously in the ROM 12 is transferred to the register B of the RAM 13 in step 120, and the stitching cycle counter of the RAM 13 for counting the number of stitching cycles of the needle is cleared in step 130 before starting the sewing operation.

After steps 100 to 130 have been executed, a query is made in step 140 to see if the enlargement switch 23 is operated. When the response in step 140 is affirmative, the enlarged pattern size indicated by operation of switch 23 is stored in register B in step 145. Next, a query is made in step 150 to see if the pattern size specified by operating the enlargement switch 23 and stored in register B is within a predetermined range, for example, the range of 3 mm to 9 mm. When the response in step 150 is affirmative, the stitching cycle counter of the RAM 13 is cleared in step 170. If the response in step 150 is negative, e.g., due to excessive operation of switch 23, a maximum pattern size is stored in register B in place of the previously stored out of range value in step 160 and processing proceeds to step 170.

After steps 140 to 170 have been executed, steps 180 to 210 are executed. Steps 180 to 210 are similar to steps 140 to 170, except that the condition of the reduction switch 24 is examined instead of that of the enlargement switch 23. When a reduced pattern size specified by operating the reduction switch 24 in step 180 and stored in register B in step 185 is within the predetermined range (step 190), the the stitching cycle counter is cleared in step 210. When the specified pattern size is outside the predetermined range, a minimum pattern size is stored in register B in place of the out of range value in step 200 and processing proceeds to step 210.

Subsequently, a query is made in step 220 to see if the specified pattern size is greater than a reference pattern size stored previously in the ROM 12. The triple stitch data stored in the ROM 12 is set in step 230 when the response in step 220 is affirmative or the single stitch data stored in the ROM 12 is set when the response in step 220 is negative, and then routine goes to RETURN to end the routine. The pattern data is set by transferring the top address in the ROM 12 where the pattern data is stored to the register C of the RAM 13. In this embodiment, the default pattern size, i.e., the default pattern width, is 6 mm. The triple stitch data is set when the pattern size specified by operating the enlargement switch 23 or the reduction switch 24 is in the range of 6 mm to 9 mm or the single stitch data is set when the specified pattern size is in the range of 3 mm To 5.5 mm. Therefore the reference pattern size is 5.5 mm.

Thus, the foregoing stitch mode selecting procedure stores a default pattern size in the register B of the RAM 13, and a pattern size specified by operating the enlargement switch 23 or the reduction switch 24 is stored in the register B of the RAM 13 when the enlargement switch 23 or the reduction switch 24 is operated. In case the pushbutton of the enlargement switch 23 or the reduction switch 24 is pushed an excessive number of times, the maximum pattern size (9 mm) or the minimum pattern size (3 mm) is selected.

After the stitch mode, i.e., the single stitch mode or the triple stitch mode, has been specified, the start-stop switch 21 is operated to provide a start signal for starting a sewing operation control routine (not shown). Then, pattern data is outputted from the ROM 12 based on the contents of registers A, C. The pattern data outputted from the ROM 12 is adjusted by being multiplied by a ratio of the specified pattern size stored in the register B to the default pattern size. The pattern is formed based on the adjusted pattern data in the enlarged or reduced size. A display control routine, not shown, controls the display driving circuit 52 of the display unit 50 on the basis of data stored in the registers A, B and C of the RAM 13 to display the selected pattern and its specified pattern size on the display 51.

Thus, the stitch pattern sewing machine sets the triple stitch mode when the specified pattern size is greater than a given reference pattern size or the single stitch mode when the specified pattern size is equal to or smaller than the given reference pattern size. Accordingly, the thickness of stitch lines forming the pattern is agreeable to the pattern size, so that the stitch pattern is very attractive and stitches are not crowded excessively even in sewing a pattern in a reduced pattern size.

The following is a description of modified embodiments of the present invention.

The stitch modes may include, in addition to the foregoing single stitch mode and the triple stitch mode, a five-fold overlap stitch mode and a seven-fold overlap stitch mode.

Even if the triple stitch mode is selected initially, all the portions of the pattern need not be sewn in the triple stitch mode; the stitch mode may be changed for a portion of the pattern to the single stitch mode, a double stitch mode and/or a quadruple stitch mode if desired. Pattern data may be provided in ROM 12 providing different stitch modes for different portions of the pattern based on the selected pattern size. For example, upon enlargement of a pattern, multiple stitch pattern data comprising data for producing both multiple overlap stitches and single stitches within a pattern may be selected.

Although the stitch pattern sewing machine in the foregoing embodiment is provided with individual pattern data respectively for the single stitch mode and the triple stitch mode, the stitch pattern sewing machine may be provided with only the pattern data for the single stitch mode to reduce the quantity of data to be stored in the ROM 12, and pattern data for a multiple overlap stitch mode may be produced by processing the pattern data for the single stitch mode.

Furthermore, although the stitch pattern sewing machine in the foregoing embodiment forms a pattern by a combined effect of feeding the workpiece in the lengthwise directions and swinging the needle bar in directions perpendicular to the lengthwise directions, a stitch pattern sewing machine in accordance with the present invention may employ a pattern forming system which drives the feed dog for movement in both lengthwise and lateral directions or a pattern forming system which moves an embroidery frame holding a workpiece in lengthwise and lateral directions.

What is claimed is:

1. A stitch pattern sewing machine comprising:

pattern storage means for storing patterns to be formed on a workpiece;

pattern selecting means for selecting a pattern stored in said pattern storage means;

size setting means for setting a size of the pattern selected by said pattern selecting means;

multiple overlap stitch setting means for setting a number of overlap stitches for at least a portion of said pattern based on the size of the pattern set by said size setting means; and stitch forming means for forming a stitch pattern corresponding to the pattern selected by said pattern selecting means based on the size of the pattern set by said size setting means and the number of overlap stitches set by said multiple overlap stitch setting means.

2. A stitch pattern sewing machine according to claim 1, wherein said multiple overlap stitch setting means has a single stitch setting and a triple stitch setting; and said triple stitch setting is set when a selected pattern size exceeds a predetermined size and said single stitch setting is set when the selected pattern size is equal to or less than said predetermined size.

3. A stitch pattern sewing machine comprising:

pattern data storage means for storing multiple stitch pattern data for a large size pattern, said multiple stitch pattern data including data for producing at least one multiple overlap stitch, and single stitch pattern data for a small size pattern, for each pattern of a plurality of different patterns;

pattern selecting means for selecting one of said different patterns;

size setting means for setting a size of the pattern selected by said pattern setting means;

pattern data selecting means for selecting one of the multiple stitch pattern data and single stitch pattern data based on the size of the pattern set by said size setting means; and stitch forming means for forming a stitch pattern on a workpiece based on the size of the pattern set by said size setting means and the pattern data selected by said pattern data selecting means.

4. A stitch pattern sewing machine according to claim 3, wherein the multiple stitch pattern data is comprised entirely of data for producing multiple overlap stitches.

5. A stitch pattern sewing machine according to claim 3, wherein the multiple stitch pattern data is comprised of data for producing multiple overlap stitches and single stitches within the stitch pattern.

6. A stitch pattern sewing machine comprising:

pattern storage means for storing patterns to be formed on a workpiece, each pattern being defined by a plurality of needle locations with a stitch longitudinally extending between adjacent needle locations;

pattern selecting means for selecting a pattern stored in said pattern storage means;

size setting means for setting a size of the pattern selected by said pattern selecting means; and means for varying a transverse thickness of the selected stitch pattern based on the size of the pattern set by said size setting means by varying the number of stitches between adjacent needle locations.

7. A stitch pattern sewing machine comprising:

pattern storage means for storing patterns to be formed on a workpiece, each pattern being defined by a plurality of needle locations with a stitch longitudinally extending between adjacent needle locations;

pattern selecting means for selecting a pattern stored in said pattern storage means;

size setting means for setting a size of the pattern selected by said pattern selecting means, the size of the pattern being determined by a longitudinal length of the stitch between adjacent needle locations; and means for varying a transverse thickness of the selected stitch pattern based on the size of the pattern set by said size setting means by varying the number of stitches between adjacent needle locations.

* * * * *